US008840226B2

(12) United States Patent
Kawamura et al.

(10) Patent No.: US 8,840,226 B2
(45) Date of Patent: Sep. 23, 2014

(54) LIQUID DISCHARGE HEAD AND METHOD OF PRODUCING LIQUID DISCHARGE HEAD

(75) Inventors: Shogo Kawamura, Numazu (JP); Toshiaki Hirosawa, Hiratsuka (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/171,048

(22) Filed: Jun. 28, 2011

(65) Prior Publication Data

US 2012/0007926 A1 Jan. 12, 2012

(30) Foreign Application Priority Data

Jul. 7, 2010 (JP) ..... 2010-154954

(51) Int. Cl.
*B41J 2/14* (2006.01)
*B41J 2/16* (2006.01)

(52) U.S. Cl.
CPC ..... *B41J 2/14072* (2013.01); *B41J 2/1623* (2013.01); *B41J 2/1607* (2013.01); *B41J 2002/14491* (2013.01); *B41J 2/14016* (2013.01); *B41J 2/14201* (2013.01); *B41J 2/1601* (2013.01)
USPC ..... 347/50; 347/58; 347/59; 347/54

(58) Field of Classification Search
USPC ..... 347/50, 58, 59, 54, 20
See application file for complete search history.

(56) References Cited

U.S. PATENT DOCUMENTS

| | | | | |
|---|---|---|---|---|
| 7,419,246 | B2 | 9/2008 | Malpica | |
| 7,533,960 | B2 * | 5/2009 | Yasuda et al. | 347/40 |
| 2002/0071002 | A1 * | 6/2002 | Kawamura et al. | 347/50 |
| 2002/0152607 | A1 * | 10/2002 | Komplin et al. | 29/611 |
| 2007/0008375 | A1 * | 1/2007 | Tanikawa et al. | 347/50 |
| 2007/0206062 | A1 * | 9/2007 | Malpica | 347/58 |
| 2008/0024542 | A1 * | 1/2008 | Miyazaki et al. | 347/20 |
| 2009/0267994 | A1 * | 10/2009 | Suganuma et al. | 347/59 |
| 2010/0013889 | A1 * | 1/2010 | Yamamoto et al. | 347/44 |

FOREIGN PATENT DOCUMENTS

| | | | |
|---|---|---|---|
| CN | 1721191 | A | 1/2006 |
| CN | 1883950 | A | 12/2006 |
| CN | 1982066 | A | 6/2007 |
| JP | 2005-305960 | A | 11/2005 |
| JP | 2007-007866 | A | 1/2007 |
| JP | 2007-296638 | A | 11/2007 |

* cited by examiner

*Primary Examiner* — Henok Legesse
(74) *Attorney, Agent, or Firm* — Canon USA Inc IP Division

(57) ABSTRACT

A liquid discharge head includes an element substrate including an energy generating element; a supporting member adhesively supporting the element substrate; a sheet member adhesively bonded to the supporting member to adjoin the inner surface of an opening accommodating the element substrate in the sheet member and an end section of the element substrate; a wiring substrate bonded to the sheet member to adjoin the inner surface of an opening accommodating the element substrate in the wiring substrate and the end section of the element substrate and including a wire electrically connected to the energy generating element; and a sealant sealing a part electrical connecting the wiring substrate and element substrate, wherein the height of a wiring substrate surface opposite to that contacting the sheet member from supporting member is smaller than the element substrate surface opposite to that contacting the supporting member from the supporting member.

5 Claims, 4 Drawing Sheets

LIQUID DISCHARGE HEAD AND METHOD OF PRODUCING LIQUID DISCHARGE HEAD

BACKGROUND OF THE INVENTION

1. Field of the Invention

The present invention relates to a liquid discharge head that carries out recording by discharging liquid, such as ink, and a method of producing a liquid discharge head.

2. Description of the Related Art

Recently, there has been a need for high-speed recording using inkjet recording apparatuses, and in response, full-line liquid discharge heads, which have a width equal to the width of a recording medium, such as paper, have been considered for use in inkjet recording apparatuses.

As an example of such a full-line liquid discharge head, FIG. 1 in Japanese Patent Laid-Open No. 2007-296638 illustrates a configuration of element substrates, each including energy generating elements and discharge ports for discharging ink.

With a liquid discharge head having such a configuration, element substrates and flexible wiring substrates are disposed on a supporting member and the arranged element substrates and wiring substrates are electrically connected.

Each wiring substrate applies electrical signals instructing ink discharge to a corresponding element substrate, has an opening in which the corresponding element substrate is disposed, and is adhesively secured onto the main surface of the supporting member.

With such a full-line liquid discharge head, the element substrates and the wiring substrates, which have a relatively large area, are electrically connected. When connected, the wiring substrates may expand and/or contract due to heat generated during production and/or while performing recording.

To prevent the electrical connection between the element substrates and the wiring substrates from failing due to expansion and/or contraction of the wiring substrates, it is desirable to provide an electrical connection by wire bonding using wires made of, for example, gold.

The flexible wiring substrates are made of a flexible, thin material.

When such a thin wiring substrate is bonded to the supporting member and wire-bonded to a corresponding element substrate, the following problem occurs.

When an excessive amount of adhesive is applied between the wiring substrate and the supporting member and the wiring substrate and the supporting member are pressed together for bonding, the adhesive flows out from between the wiring substrate and the supporting member to the upper surface of the wiring substrate.

Since the wiring substrate is extremely thin, e.g., 0.15 mm, sometimes the adhesive moves up the end surface of the opening in the wiring substrate along the electrical terminals of the wiring substrate and spreads to the bonding points of the wires.

The adhesive covering the bonding points in such a manner adversely affects the subsequent wire bonding.

When the amount of adhesive is reduced in consideration of such spreading of the adhesive, the adhesive does not reach the edge of the opening in the wiring substrate and forms a space not filled with the adhesive between the wiring substrate and the supporting member.

If such a space is formed near a bonding point, ultrasonic energy is dispersed during wire bonding, having an adverse effect on the wire bonding.

Accordingly, it is necessary to precisely control the amount of adhesive, but such precise control carried out during the production process may reduce productivity.

In inkjet recording, it is desirable that the distance between the discharge port surface of the liquid discharge head and the recording medium (paper distance) be small to increase the impact precision of the discharged ink droplets to achieve high-quality recording.

Electrical connection established by wire bonding, such as that described above, causes the paper distance to be large because the wires are arc shaped.

SUMMARY OF THE INVENTION

Accordingly, the present invention provides a liquid discharge head by preventing an increase in the distance between the liquid discharge head and paper, achieving excellent bonding of the wiring substrates and the supporting member, enabling highly reliably wire bonding of the element substrates and the wiring substrates.

The liquid discharge head includes an element substrate including an energy generating element for generating energy to be used to discharge liquid from a discharge port; a supporting member for supporting the element substrate by an adhesive; a sheet member having a first opening accommodating the element substrate and bonded to the supporting member with an adhesive so as to adjoin the inner surface of the first opening and an end section of the element substrate; a wiring substrate having a second opening accommodating the element substrate, bonded to the sheet member with an adhesive so as to adjoin an inner surface of the second opening and an end section of the element substrate, and including a wire electrically connected to the energy generating element; and a sealant for sealing an electrically connected part of the wiring substrate and the element substrate, wherein the height of a surface of the wiring substrate opposite to the surface contacting the sheet member with respect to supporting member is smaller than the height of a surface of the element substrate opposite to the surface contacting the supporting member with respect to the supporting member.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

First Embodiment

The configuration of an inkjet liquid discharge head (hereinafter also simply referred to as "liquid discharge head") according to embodiments will be described below with reference to the exploded perspective view in FIG. 3.

Figure 3:
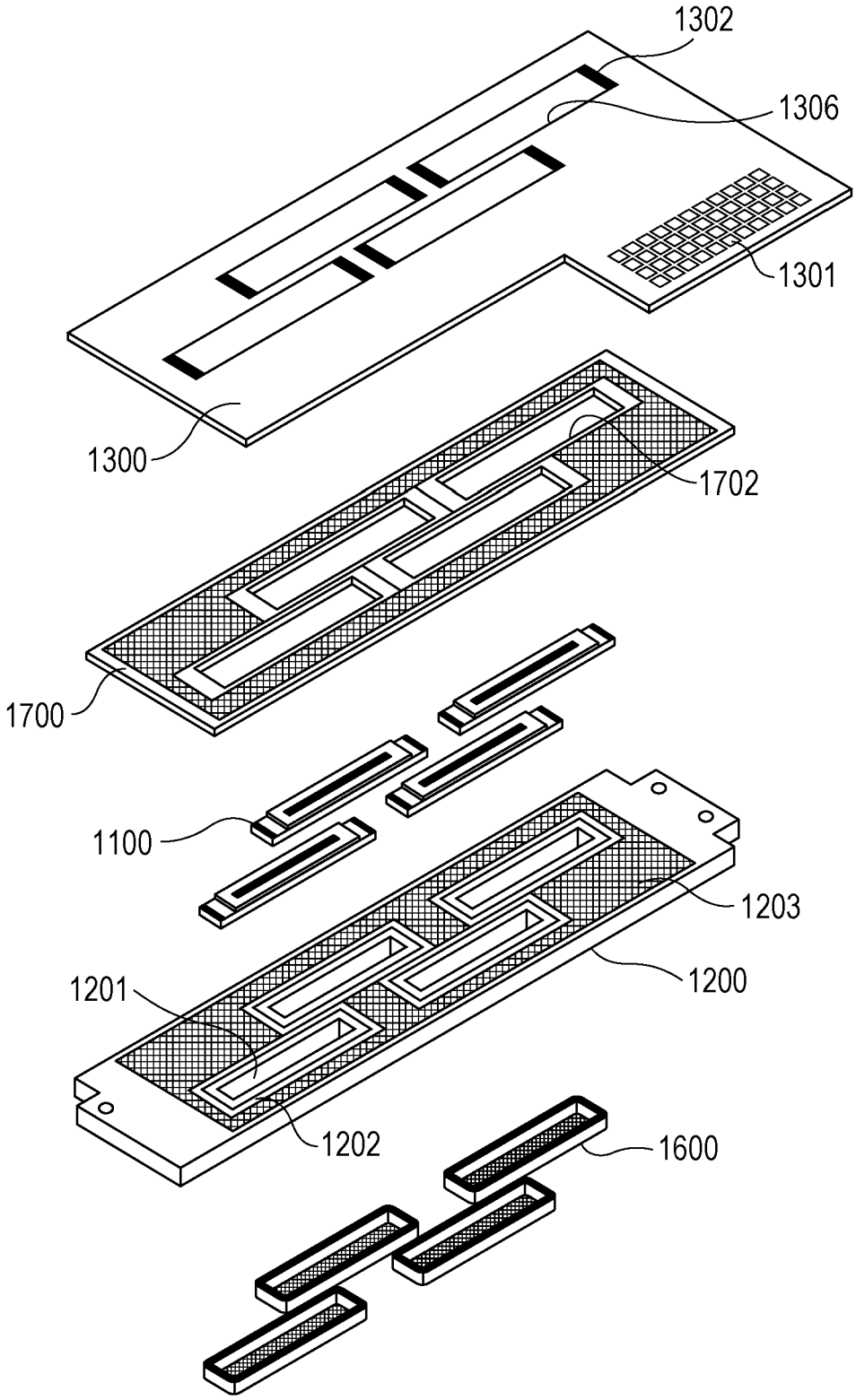
FIG. 3 is an exploded perspective view of a liquid discharge head.

As illustrated in FIG. 3, a liquid discharge head according to a first embodiment includes a wiring substrate 1300, a sheet member 1700, element substrates 1100, a supporting member 1200, and filter members 1600.

The configuration of the components will be described in detail below.

An element substrate 1100 has an energy generating element that generates energy for discharging liquid, such as ink, and discharge ports from which the ink is discharged. The element substrate 1100 is positioned on the supporting member 1200.

In this embodiment, four element substrates 1100 are disposed on the upper surface of the supporting member 1200 in a checkered, or staggered pattern to constitute a full-line liquid discharge head, which has a width that is the same as the width of a recording medium, such as paper.

The element substrate 1100 according to this embodiment is made of a Si substrate having a thickness of approximately 0.6 millimeters (mm) to 0.8 mm and includes electrodes 1103 (see FIG. 1), which are disposed on the surface near the edge of the element substrate 1100 and are connected to a wiring substrate (described below).

The supporting member 1200 is made of ceramic, such as alumina, has ink supply ports 1201 for supplying ink to the element substrate 1100, and is adhesively secured to the element substrate 1100 with a first adhesive 1202.

The wiring substrate 1300 includes a 0.025 mm to 0.050 mm thick polyamide resin film on both sides of which 0.01 mm to 0.02 mm thick copper wiring members are patterned and has openings 1306 in which the element substrates 1100 are mounted.

The wiring substrate 1300 according to this embodiment has a two-layer structure of a first layer disposed on the supporting member 1200 side and a second layer disposed on the wiring substrate 1300 on the side opposite to the supporting member 1200.

The first layer includes, in order from the side of the supporting member 1200, a cover film of approximately 4 micrometer (μm) thick aramid resin, an approximately 20 μm thick copper wiring layer, which is bonded to the cover film by an adhesive layer, and an approximately 25 μm thick polyamide resin base film, which is bonded to the wiring layer with another adhesive layer.

Electrode terminals 1302 that are electrically connected to the element substrate 1100 are provided at the end (edge) of the opening 1306 in the flexible wiring substrate 1300.

The electrode terminals 1302 are electrically connected via wires to external signal input terminals 1301, which are connected to electric contacts of a recording apparatus.

The wiring substrate 1300, excluding the part of the electrode terminals 1302, is covered with a 0.004 mm to 0.050 mm thick resin film to prevent corrosion.

The electrode terminals 1302 are plated with gold to present corrosion.

In the liquid discharge head according to this embodiment, the plurality of element substrates 1100 is positioned and secured on the supporting member 1200. The electrode terminals of the wiring substrate 1300 are aligned with the electrodes of the element substrates 1100 and are bonded to the supporting member 1200 with a sheet member 1700 by thermocompression or other methods.

Then, the electrode terminals of the element substrates 1100 and the electrode terminals of the wiring substrate 1300 are electrically wire-bonded using a conductive wire, preferably a gold wire.

Then, the wire-bonded part is sealed and protected by a sealing member 1305.

Details of this embodiment will be described below with reference to FIGS. 1A, 1B and 3.

In this embodiment, the sheet member 1700 is interposed between the wiring substrate 1300 and the supporting member 1200.

The sheet member 1700 has openings 1702 in which the element substrates 1100 are mounted and through which the element substrates 1100 are exposed. The openings 1702 are sized and positioned to match openings 1306 in the wiring substrate 1300.

In other words, the inner surfaces of the openings 1702 in the sheet member 1700 adjoin the end sections of the element substrates 1100.

Figure 1A:
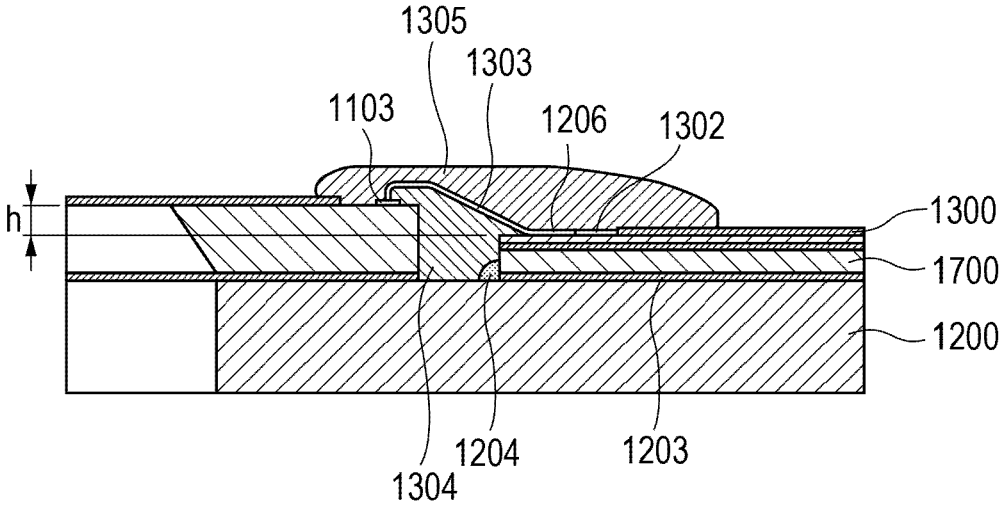
FIG. 1A is a partial sectional view of a liquid discharge head according to a first embodiment.
Figure 1B:
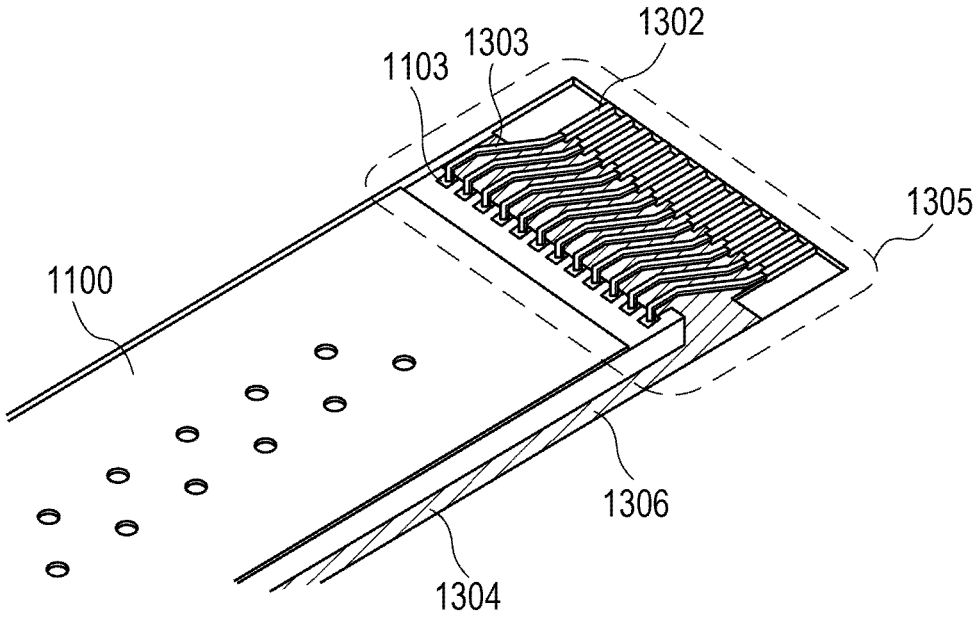
FIG. 1B is a partial perspective view of the liquid discharge head including a wire-bonded part.

As illustrated in FIGS. 1A and 1B, the thickness of the sheet member 1700 measured from the upper surface of the supporting member 1200 is set such that the height difference h between the electrodes 1103 on the upper surface of the element substrates 1100 and the electrode terminals 1302 on the upper surface of the wiring substrate 1300 is approximately 0.3 mm.

The sheet member 1700 is made by bonding together polyamide films, which are the same components used in the wiring substrate 1300.

It is desirable that the same material is used for the sheet member 1700 and the wiring substrate 1300 to prevent peeling and wrinkling caused by a difference in linear expansion due to heat. However, the material is not limited thereto and other materials having a similar linear expansion coefficient may be used.

The sheet member 1700 is not limited to films bonded together but instead may be constituted of a single plate.

The operation of the sheet member 1700 will be described below.

When too much adhesive is used directly bonding together the wiring substrate 1300 and the supporting member 1200, the adhesive may spread to the electrode terminal section of the wiring substrate 1300 and cause damage to the wire bonding.

When an insufficient amount of adhesive is used, a gap is formed between the wiring substrate 1300 and the sheet member 1700. Ultrasonic energy generated during bonding is dispersed at such a gap, causing damage to the wire bonding.

Advantages of adhesively securing the wiring substrate 1300, which is bonded to the sheet member 1700, to the supporting member 1200 is described below.

When an excessive amount of adhesive 1203 is used to bond the wiring substrate 1300, part of the adhesive 1203 spreads into the openings 1702.

Since the sheet member 1700 is approximately 0.3 mm thick, the spread adhesive 1204 does not reach the upper surface of the wiring substrate 1300 and remains on the back side of the wiring substrate 1300.

Therefore, the spread adhesive 1204 can be prevented from further spreading to bonding points 1206 of wires 1303.

When an insufficient amount of adhesive is applied, the adhesive 1203 does not spread to the end of the openings in the sheet member 1700, and a space may be formed underneath the sheet member 1700.

By providing a rigid sheet member that is thick compared to the thickness of the wiring substrate 1300, the energy generated during wire bonding can be more easily received, and wire connectivity is improved.

Accordingly, the tolerance for the amount of adhesive 1203 to be applied increases, and production is stabilized.

Second Embodiment

A second embodiment will be described below with reference to FIGS. 2A and 2B.

Figure 2A:
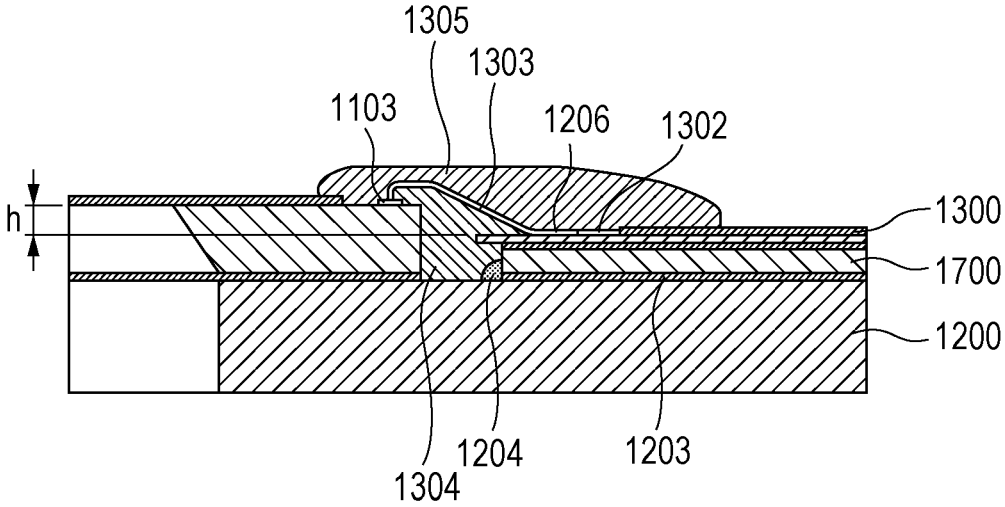
FIG. 2A is a partial sectional view of a liquid discharge head according to a second embodiment.
Figure 2B:
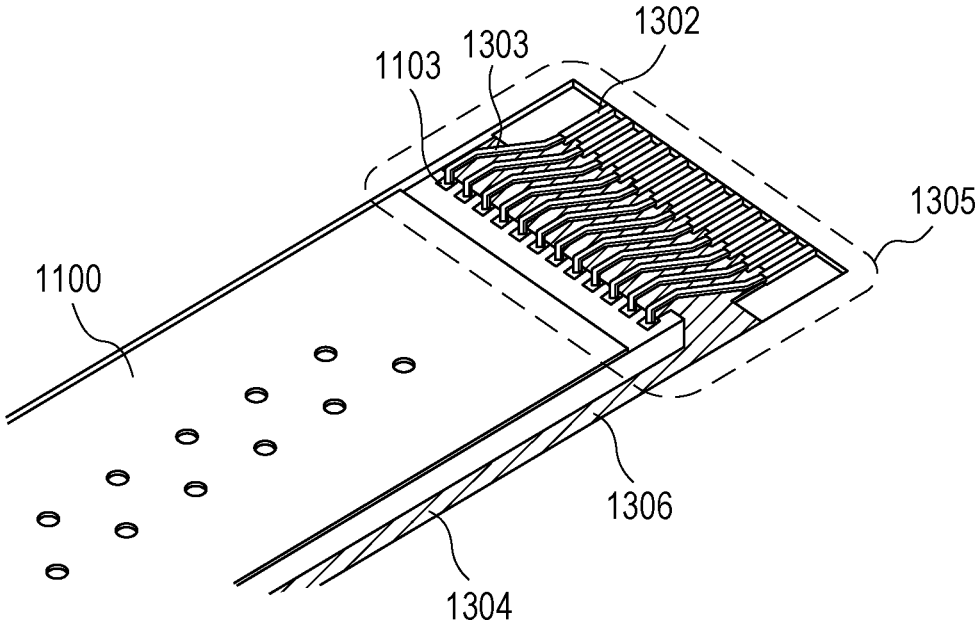
FIG. 2B is a partial perspective view of the liquid discharge head having a wire-bonded part.

The second embodiment, which is illustrated in FIGS. 2A and 2B, differs from the first embodiment, which is illustrated in FIGS. 1A and 1B, in that with respect to the end surface of the sheet member 1700, the end surface of the wiring substrate 1300 protrudes toward the element substrate 1100 for the entire circumference.

In this embodiment, the end surfaces of the wiring substrate 1300 protrude 0.3 mm into the openings in the sheet member 1700.

With such a configuration, even when the adhesive between the sheet member 1700 and the supporting member 1200 spreads out, the protruding wiring substrate 1300 efficiently prevents the adhesive from flowing up to the upper surface of the wiring substrate 1300.

Figure 4:
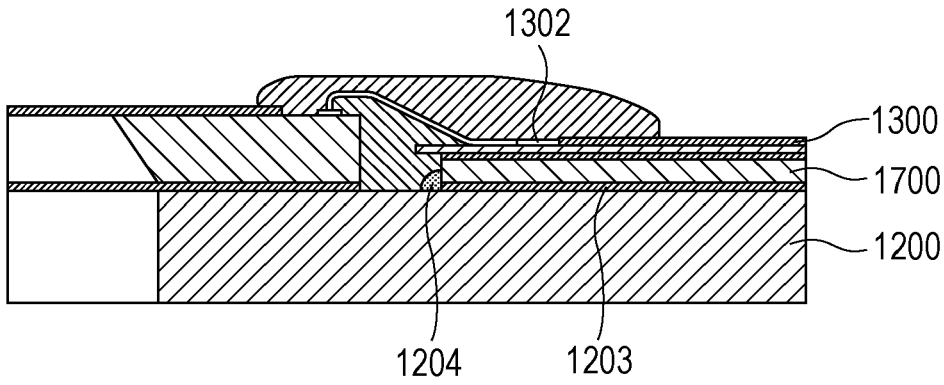
FIG. 4 is a sectional view of a liquid discharge head according to a variation of the second embodiment.

In addition to the production method of bonding the bonded sheet member 1700 and wiring substrate 1300 to the supporting member 1200 as described above, it is also possible, as illustrated in FIG. 4, to stack the sheet member 1700 and the wiring substrate 1300 separately onto the supporting member 1200.

In such a case, first, the sheet member 1700 is adhesively secured on the supporting member 1200.

Since the sheet member 1700 does not have any electrode terminals, the spreading of adhesive 1204 into the openings in the sheet member 1700 can be allowed.

Accordingly, an excessive amount of adhesive 1203 may be applied to prevent the formation of a space due to insufficient adhesive application to the bonding surface of the sheet member 1700.

After the adhesive 1203 is cured, the supporting member 1200 is adhesively secured to the sheet member 1700.

Since the openings 1306 in the element substrates 1100 are smaller than the openings 1702 in the sheet member 1700, i.e., since the element substrates 1100 protrudes into the openings 1702 in the sheet member 1700, an excessive amount of adhesive can be applied, allowing the adhesive to spread into the openings 1702 in the sheet member 1700.

Since the adhesive spread into the openings 1702 in the sheet member 1700, the adhesive can be prevented from contacting the electrode terminals on the wiring substrate 1300.

In this embodiment, the thickness of the sheet member 1700 is set such that the height of the electrode parts of the element substrates 1100 is smaller than the height of the terminal parts of the wiring substrate 1300.

That is, the thickness of the sheet member 1700 is set such that the total thickness of the sheet member 1700 and the wiring substrate 1300 is smaller than the thickness of the element substrates 1100.

The liquid discharge head of an inkjet printer has high impact precision of the discharged ink droplets when the distance between the discharge ports and the medium, such as paper, is small, and thus, the printing quality is improved.

The height of the wiring substrate 1300 may be set to the same height as the surface provided with the discharge ports. To decrease the distance to the medium, however, it is necessary to linearly dispose the gold wires 1303 substantially parallel to the discharge port surface.

In such a case, the electrodes 1103 of the element substrates 1100, the electrode terminals 1302 of the wiring substrate 1300, and the gold wires 1303 are aligned.

When the wires 1303 disposed in such a manner are exposed to a temperature change, the connected parts may detach due to being unable to absorb the difference in the linear expansion of the components, and unsatisfactory electrical connection may occur.

Thus, by setting the thickness of the sheet member 1700 such that the height of the electrode terminals of the wiring substrate 1300 is smaller than the height of the electrodes of the element substrates 1100, the length can be set with a margin so long as the gold wires do not largely protrude from the discharge port surface.

Accordingly, detachment of the electrically connected parts due to a difference in linear expansion can be prevented, thus improving reliability.

Sealing of the wire bonding part will be described below.

In this embodiment, the electrically connected parts of the element substrates 1100 and the wiring substrate 1300 are sealed with two different types of sealants.

One sealant is used to seal the back side of the wires, which are the electrically connected part, and the other sealant is used to seal the front side of the wires.

The back side is sealed with a low-viscosity sealant 1304 of 30 Pascal Seconds (Pa·S) or lower by applying the sealant 1304 in a gap formed by the element substrates 1100, the wiring substrate 1300, and the sheet member 1700.

The sealant is applied to the sides on which the gold wires are provided by an amount that does not fill the space below the gold wires, or the sealant is not applied to the sides on which the gold wires are provided but is applied by an excessive amount to the sides on which the gold wires are not provided so that the sealant naturally flows beneath the gold wires.

Since a sufficiently deep groove is formed around the element substrates 1100 by the sheet member 1700, the sealant flows through this groove beneath the gold wires.

The height difference in the gold wire structure is reduced by the thickness of the sheet member 1700, compared to when the sheet member 1700 is not provided.

Therefore, the low-viscosity sealant is prevented to a certain extent from leaking out to the surroundings by its own weight and from forming a space beneath the gold wires due to not being able to reach the electrode part on the upper side of the element substrates 1100.

The sealant stops from spreading by forming meniscuses between the gold wires.

With a configuration according to the related art, there is a possibility that the sealant spreads to the surroundings when the space beneath the gold wires is filled with a low-viscosity sealant.

In such a case, the sealant applied in the subsequent step slides on the spread low-viscosity sealant and cannot be applied stably. Therefore, it is necessary to cure the low-viscosity sealant before the subsequent step.

In a case in which a space is formed beneath the gold wires, the application speed of the sealant in the subsequent step is reduced so that the slowly applied sealant flows around the back of the gold wires.

With such a configuration, it is possible to prevent the process time from increasing.

The sealant 1304 is applied by an amount that is sufficient for forming meniscuses between the gold wires such that the back of the gold wires is filled.

At the sides on which the gold wires are not provided, the sealant 1304 is applied by an amount that fills the groove formed by the element substrates 1100, the wiring substrate 1300, and the sheet member 1700.

In this way, as illustrated in FIG. 3, a minimum amount of sealant can be applied to parts other than the back side of the gold wires before proceeding to the subsequent step of applying the second sealant.

By heating the supporting member 1200 to approximately 50° C. when applying low-viscosity sealant and filling the back of the gold wires, bubbles are prevented from forming and the sealant can flow smoothly.

In the subsequent step, a high-viscosity sealant 1305 of 70 Pa·S or higher is applied to seal the electrically connected parts including the front side of the gold wires.

Since the sealant 1304 forms meniscuses between the gold wires and does not spread to the surroundings, the parts other than the groove filled with the low-viscosity sealant remain dry.

Thus, the high-viscosity sealant 1305 is applied to the wiring substrate 1300 and the element substrates 1100 without sliding on the low-viscosity sealant 1304.

Thus, a step of curing the low-viscosity sealant in advance is not required, and takt time is improved.

By heating and curing the low-viscosity and high-viscosity sealants, which are applied as described above, the production process can be shortened.

Third Embodiment

Figure 5:
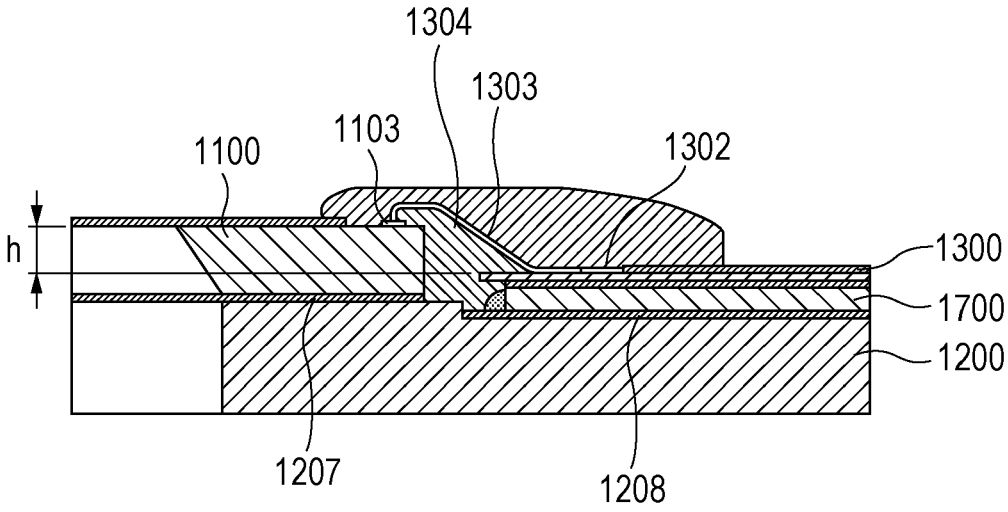
FIG. 5 is a sectional view of a liquid discharge head of a third embodiment.

FIG. 5 is a sectional view of a liquid discharge head according to a third embodiment.

In this embodiment, as illustrated in FIG. 5, a bonding surface 1207 of the supporting member 1200 bonded to the element substrates 1100 and a bonding surface 1208 of the supporting member 1200 bonded to the sheet member 1700 are set at different heights, where the bonding surface 1208 is lower than the bonding surface 1207.

By setting the height of the bonding surface 1208 lower in this way, the flexibility in the thickness of the sheet member 1700 increases, and the rigidity can be adjusted.

Moreover, the height difference h between the electrodes 1103 of the element substrates 1100 and the electrode terminals 1302 of the wiring substrate 1300 can be adjusted more easily.

The height difference h may be set to a value that enables meniscuses to be formed between the gold wires 1303 when the low-viscosity sealant 1304 is filled.

Since a large height difference h provides a margin in the length of the gold wires 1303 in the linear expansion direction of the element substrates 1100 and the wiring substrate 1300, even when a temperature difference occurs, the electrically connected part is less likely to be detached.

According to the configuration described above, the thickness of the sheet member 1700 can be increased, and rigidity can be increased. Therefore, the reliability of the electrical connection by wire bonding can be improved.

Since there is a margin in the length of the gold wires, the electrical reliability can be improved even when a temperature change occurs.

The present invention can be applied to typical printing apparatuses, as well as, apparatuses such as copiers, facsimiles having a communication system, word processors having a printing unit, and industrial recording apparatuses, which form composites with various different processing devices.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-154954 filed Jul. 7, 2010, which is hereby incorporated by reference herein in its entirety.

What is claimed is:

1. A liquid discharge head comprising:

an element substrate including an energy generating element for generating energy to be used to discharge liquid from a discharge port;

a supporting member for supporting the element substrate, and bonded to the element substrate with a first adhesive;

a sheet member having a first opening accommodating the element substrate and bonded to the supporting member with a second adhesive so as to adjoin the inner surface of the first opening and an end section of the element substrate;

a wiring substrate having a second opening accommodating the element substrate, bonded to the sheet member with a third adhesive so as to adjoin an inner surface of the second opening and an end section of the element substrate, and including a wire electrically connected to the energy generating element; and a sealant for sealing an electrically connected part of the wiring substrate and the element substrate, wherein the sheet member is thicker than the wiring substrate, and wherein the height of a surface of the wiring substrate opposite to a surface contacting the sheet member with respect to the supporting member is smaller than the height of a surface of the element substrate opposite to a surface contacting the supporting member with respect to the supporting member, wherein a rigidity of the sheet member is greater than a rigidity of the wiring substrate thereby improving wiring connectivity during wire bonding, and wherein the second adhesive does not reach an upper surface of the wiring substrate, and wherein the bonding surface of the supporting member and the sheet member is disposed at a position lower than the position of the bonding surface of the supporting member and the element substrate.

2. The liquid discharge head according to claim 1, wherein the sheet member and a base film covering the wire of the wiring substrate are made of the same material.

3. The liquid discharge head according to claim 1, wherein the sheet member is constituted of a stack of a plurality of sheets bonded together.

4. The liquid discharge head according to claim 1, wherein the end section of the wiring substrate protrudes toward the element substrate with respect to the end section of the sheet member.

5. The liquid discharge head according to claim 1, wherein a plurality of element substrates is arranged on the supporting member, and the wiring substrate has a plurality of openings accommodating the element substrates.

* * * * *